United States Patent [19]

Spaulding

[11] Patent Number: 4,786,260

[45] Date of Patent: Nov. 22, 1988

[54] ELECTRICAL CABLE ASSEMBLY

[75] Inventor: Tedford H. Spaulding, Chicago, Ill.

[73] Assignee: Switchcraft, Inc., Chicago, Ill.

[21] Appl. No.: 171,243

[22] Filed: Mar. 18, 1988

Related U.S. Application Data

[63] Continuation of Ser. No. 872,583, Jun. 10, 1986, abandoned.

[51] Int. Cl.[4] ..... H01R 13/424; H01R 13/648

[52] U.S. Cl. ..... 439/607; 439/610; 29/861; 29/884

[58] Field of Search ..... 29/861, 874, 884; 439/607, 610

[56] References Cited

U.S. PATENT DOCUMENTS

| | | | |
|---|---|---|---|
| 3,820,055 | 6/1974 | Hufnagle et al. . | |
| 3,825,874 | 7/1974 | Peverill | 339/147 R X |
| 4,126,370 | 11/1978 | Nisman | 339/143 R |
| 4,372,634 | 2/1983 | Ritchie et al. . | |
| 4,387,950 | 6/1983 | Guzik et al. . | |
| 4,408,820 | 10/1983 | Eaby et al. . | |
| 4,494,092 | 1/1985 | Griffin | 339/147 R X |
| 4,519,665 | 5/1985 | Althouse et al. | 339/143 R X |

OTHER PUBLICATIONS

D-Subminiatures.

"Reducing EMI/RFI Through Filters, Shielding and Shield Termination", by Ed Cieniawa from Connection Technology May 1986.

"User Friendly", Connector Termination by Jim Robinson from Connection Technology May 1985.

*Primary Examiner*—P. W. Echols

*Assistant Examiner*—Taylor J. Ross

*Attorney, Agent, or Firm*—William R. Clark; Richard M. Sharkansky

[57] ABSTRACT

An electrical cable assembly comprising a multi-conductor cable having an end portion terminating in a multi-contact connector which includes a rigid shielding shell of electrically conductive material disposed to receive therein a dielectric insert for supporting a plurality of terminal contact members secured to respective conductors in the cable. The dielectric insert comprises a trough-like body and a cover for disposing over the opening of the body, the cover and an opposing bottom wall of the body being provided with respective similar pluralities of mutually spaced holes wherein the terminal contact members are installed. The cover is provided with a plurality of flexible tabs which engage respective ramp portions of the body for locking the cover on the body to form a unitary terminal-supporting structure prior to assembly in the rigid shielding shell of the connector.

17 Claims, 5 Drawing Sheets

ELECTRICAL CABLE ASSEMBLY

This application is a continuation of application Ser. No. 872,583 filed June 10, 1986 now abandoned.

BACKGROUND OF THE DISCLOSURE

1. Field of the Invention

This invention relates generally to electrical cable assemblies and is concerned more particularly with an electrical connector having dielectric component parts provided with latching means for forming a unitary terminal-supporting member prior to assembly in the connector.

2. Discussion of the Prior Art

An electrical cable assembly may include a multi-conductor cable having an end portion terminating in a multi-contact connector comprising a rigid frame of electrically conductive material encircling a dielectric insert for supporting terminal contact members in predetermined spaced relationship with one another. The dielectric insert generally is comprised of a box-like body having a bottom wall provided with a plurality of contact-receiving holes and having an opposing opening closed by a cover provided with a similar plurality of through-holes. The body and the cover may be provided with conventional keying means for ensuring that the cover is properly oriented relative to the body and each of the through-holes in the cover is aligned with a respective contact-receiving hole in the bottom wall of the body. The frame generally is comprised of a metallic backshell wherein the dielectric insert is assembled such that the bottom wall of the insert body protrudes from the rear of the backshell, and a metallic frontshell which is mounted over the insert cover and fastened securely to the backshell. Thus, the frontshell being fastened to the backshell serves to hold the insert cover in operative relationship with the insert body and retain the dielectric insert, as a unit, within the frame of the connector.

The electrical cable is terminated in the connector by end portions of the conductors in the cable being stripped and secured by conventional means to respective terminal contact members. Then, these contact members are inserted into respective contact-receiving holes in the bottom wall of the insert body protruding from the rear of the backshell. Therefore, until all of the terminal contact members are installed, it is necessary that the bottom wall of the insert body be maintained accessible from the rear of the backshell. Consequently, if the cable assembly is to be of the shield type, an additional shielding member is required to be mounted over the rear of the backshell after all of the contact members have been installed in the dielectric insert. However, this additional operation and additional shielding member may increase the cost of fabricating the electrical cable assembly significantly.

SUMMARY OF THE INVENTION

Accordingly, these and other disadvantages of the prior art are overcome by this invention providing an electrical cable assembly with an electrical connector including a dielectric insert comprised of a body and a cover having respective latching means for engaging one another to fasten the cover securely to the body and thereby form a unitary insert independently of other parts of the connector. The body of the insert has a box-like structure including a bottom wall provided with a plurality of mutually spaced contact-receiving holes; and the cover is provided with a similar plurality of through-holes extending through its thickness. Consequently, the respective latching means on the body and the cover are off-set similarly from the transverse centerline of the insert to provide keying means for ensuring that the cover is properly oriented with respect to the body and that each of the through-holes in the cover is aligned with a respective contact-receiving hole in the bottom wall of the body.

This electrical connector includes a rigid shielding frame or shell of electrically conductive material which is disposed about the dielectric insert when the connector is assembled. The shielding shell includes a metallic backshell having a flatted funnel-like structure through which an end portion of an electrical cable is passed from the smaller end portion to beyond the larger end portion of the structure for termination. After terminal contact members connected electrically to stripped end portions of respective conductors in the cable are installed in the dielectric insert, the end portion of the cable is drawn back through the smaller end portion of the backshell until the dielectric insert is seated in the larger end portion thereof. Provided in the larger end portion of the backshell is a keyway means offset from the axial centerline of the backshell for receiving the latching and keying means of the insert body and cover to ensure that the dielectric insert is oriented properly with respect to the backshell. The shielding shell also includes a frontshell which is mounted over the insert cover and fastened securely to the backshell for retaining the dielectric insert within the larger end portion of the backshell.

BRIEF DESCRIPTION OF THE DRAWINGS

For a better understanding of the disclosed invention, reference is made in the following detailed description to the drawings wherein.

DESCRIPTION OF THE PREFERRED EMBODIMENTS

Figures 1, 1A:
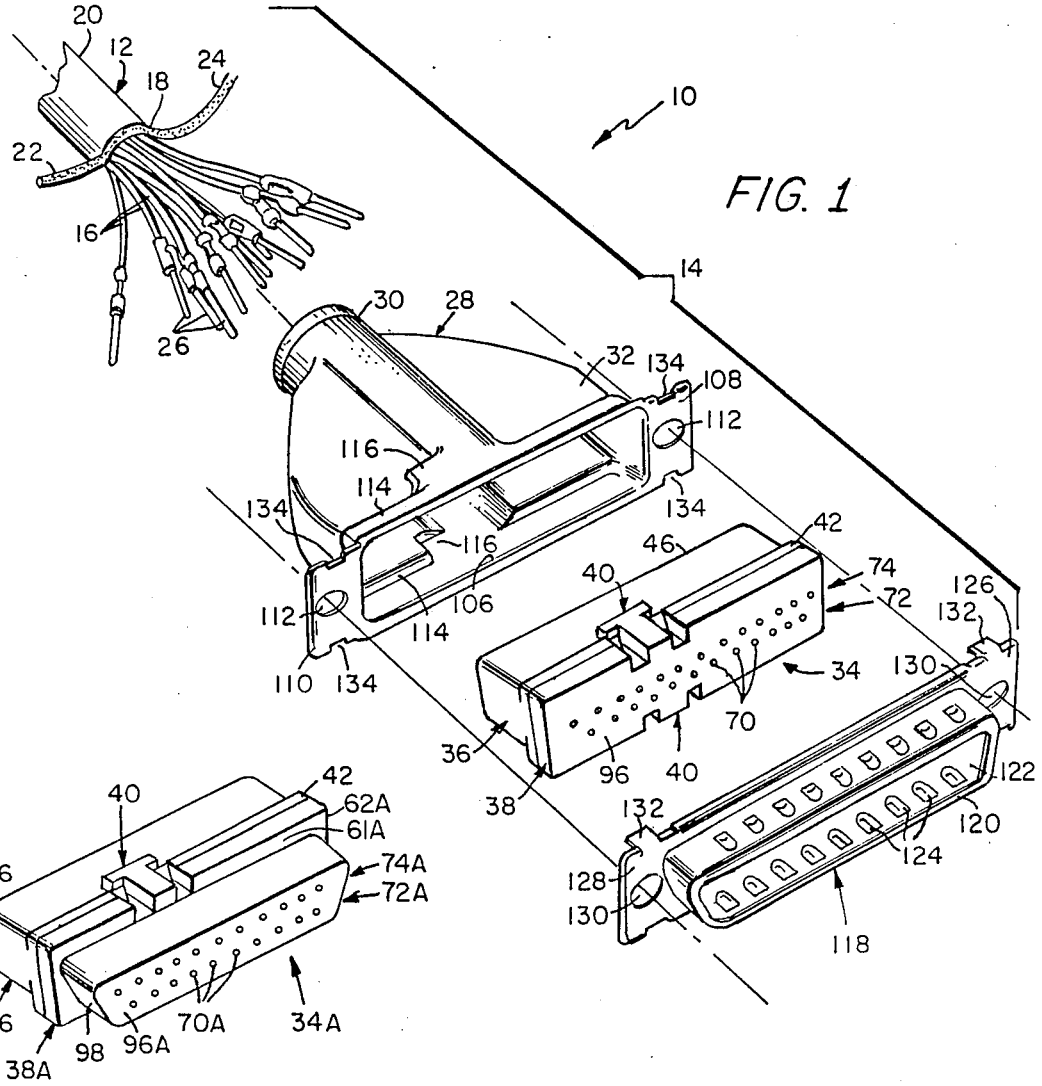
FIG. 1 is an exploded view of an electrical cable assembly.embodying the invention.
FIG. 1A is an alternative dielectric insert for use in the electrical cable assembly shown in FIG. 1.

Referring to the drawings wherein like characters of reference designate like parts, there is shown in FIG. 1 a shielded electrical cable assembly 10 comprising a multi-conductor cable 12 having an end portion terminating in a multicontact, electrical connector 14. The cable 12 may be of a conventional type, such as round cable, for example, having therein a plurality of insulation coated wire conductors 16 which are encircled by a braided shield 18 of metallic material, such as copper, for example. The shield 18, in turn, is encircled by a protective jacket 20 of dielectric material, such as a plastic material, for example.

In preparing the end portion of cable 12 for termination, the outer jacket 20 is cut back from the adjacent end of cable 12 to provide a cut-end of jacket 20 spaced a predetermined distance from the adjacent end of cable 12. The resulting exposed end portion of shield 18 is unbraided from the adjacent end of cable 12 to the cut-end of jacket 20 for twisting the unbraided portion of shield 18 into two pigtails, 22 and 24, respectively, which remain electrically connected to the shield 18. Then, the exposed end portions of conductors 16 have their respective insulation coatings stripped back suitable distances for securing to the resulting exposed wire end portions respective terminal contact members 26. The terminal contact members 26 may be secured to the exposed wire end portions of conductors 16 by well-known means, such as crimping or staking, for example. Also, although the terminal contact members 26 are shown in FIG. 1 as being of the conventional male prong type, the terminal contact members may equally well be of the conventional female socket type.

The terminal contact members 26 constitute respective component parts of the connector 14 when assembled therein for terminating the adjacent end portion of cable 12. Connector 14 also includes a rigid shielding means comprising a backshell 28 made of electrically conductive material which preferably is seamless, such as drawn steel having a thickness of about sixteen thousands of an inch, for example. The backshell 28 may be provided with a generally flatted funnel-like structure including a smaller end portion 30 which is disposed for receiving the adjacent end portion of cable 12 axially inserted therein, and an opposing larger end portion 32 through which the axially inserted end portion of cable 12 emerges. Preferably, the adjacent end portion of cable 12 is drawn through the backshell 28 with the outer jacket 20 still intact and subsequently the jacket 20 is cut, the pigtails 22 and 24 formed, and the terminal contact members 26 secured to stripped end portions of respective conductors 16, as described.

Connector 14 also includes a dielectric insert 34 having a unitary box-like structure provided with means for receiving the respective terminal contact members 26 and maintaining them in mutually spaced relationship independently of the rigid shielding means. The connector 14 comprises a trough-like body 36 and a cover 38 secured over the opening of body 36 by a latching means 40. Both the body 36 and the cover 38 are made, as by injection molding, for example, of a resilient plastic material suitable for molding.

Figure 4A:
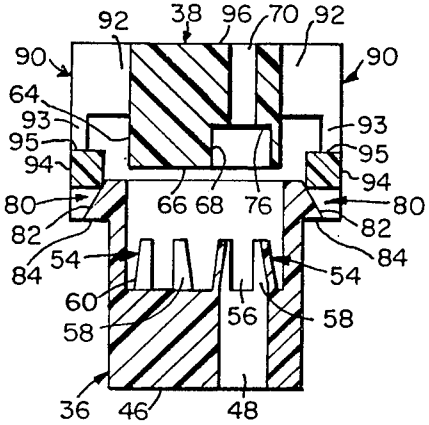
FIG. 4A is a cross-sectional view of the body and cover taken along the lines 4A—4A in FIG. 2 and FIG. 3, respectively, and looking in the direction of the arrows.
Figure 4B:
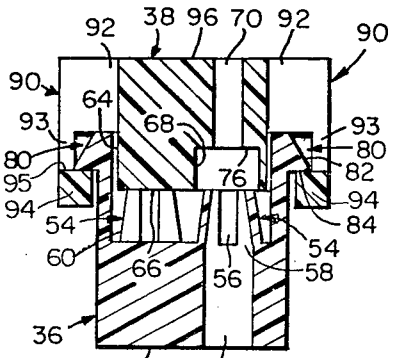
FIG. 4B is a cross-sectional view similar to that shown in FIG. 4A but with the latching means fully engaged.
Figure 2:
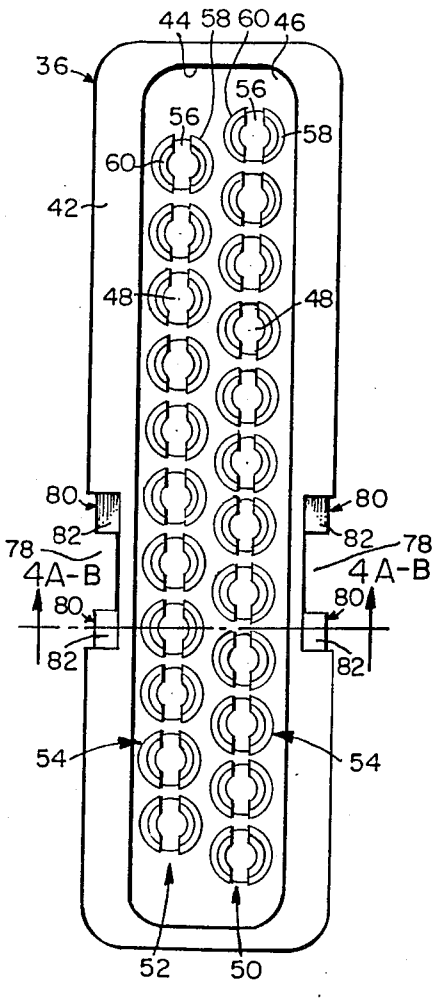
FIG. 2 is an upper plan view of the body portion of the dielectric insert shown in FIG. 1.

As shown in FIGS. 2, 4A and 4B, the trough-like body 36 includes a rim 42 defining an open end of an internal cavity 44 which has an opposing closed end provided by a bottom wall 46 of body 36. Extending through the thickness of bottom wall 46 are respective contact-receiving holes 48 which may be disposed in mutually spaced relationship in two rows or linear arrays, 50 and 52, respectively. The array 50 may include more contact-receiving holes 48 than the array 52 and, therefore, have a correspondingly greater length. The contact-receiving holes 48 are disposed within respective contact-retaining means 54 which protrude integrally from the inner surface of bottom wall 46. Each of the contact-retaining means 54 comprises a generally frusto-conical structure having axially disposed therein a slot 56 for providing adjacent the interposed hole 48 opposing arcuate grommet portions, 58 and 60, respectively. The grommet portions 58 and 60 yield resiliently to permit entry of a terminal contact member 26 into cavity 44 and spring back to a relaxed state for retaining the member 26 within cavity 44.

Figure 3:
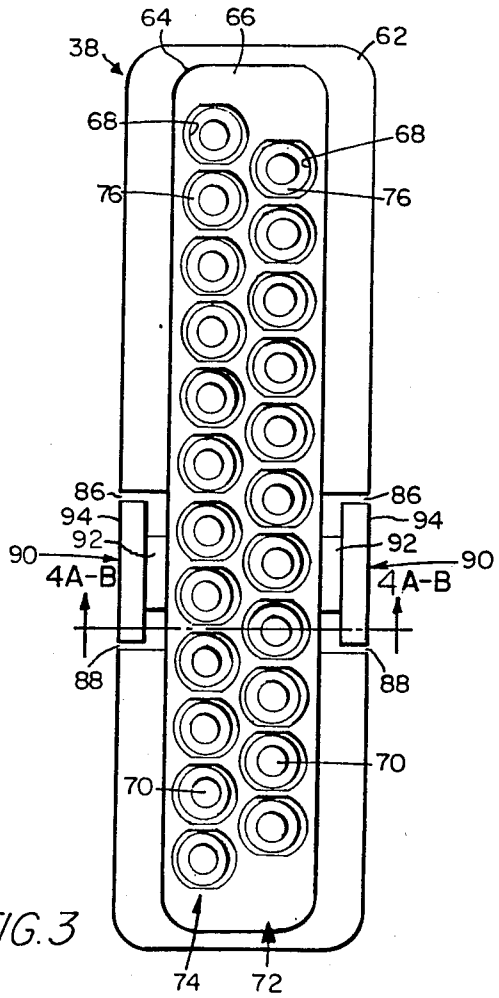
FIG. 3 is a lower plan view of the cover of the dielectric insert shown in FIG. 1.

As shown in FIGS. 3, 4A and 4B, the cover 38 has an outer marginal portion constituting an integral flange 62 which encircles a central axial portion of cover 38 comprising an inner plateau 64. The plateau 64 protrudes integrally from the inner surface of flange 62 a predetermined distance for extending into the cavity 44 of body 36 when an inner surface of flange 62 is disposed in interfacing relationship with the rim 42 of body 36. Disposed in the plateau 64 is a plurality of through-holes 70 which are mutually spaced apart in respective rows or linear arrays 74 and 72 similar to the respective arrays 50 and 52 of contact-receiving holes 48 disposed in the bottom wall 46 of body 36. Accordingly, the array 74 may include more through-holes 70 than included in the array 72 and, therefore, have a correspondingly greater length. Each of the through-holes 70 is provided with an increased diametric size adjacent an inner surface 66 of plateau 64 for forming a cavity 68 which terminates at an annular shoulder 74 at a predetermined distance from the inner surface 66 of plateau 64. The respective shoulders 76 provide positive-stop means for limiting insertion of the terminal contact members 26 into the through-holes 70 and retaining the members 26 within the dielectric insert 34.

Referring again to FIG. 2, it may be seen that opposing longitudinal portions of rim 42 offset similarly from the transverse centerline of body 36 are provided with respective rectangular openings 78. The openings 78 have their respective narrow dimensions extending laterally inward of rim 42 from the outer edge thereof to approximately the adjacent side wall of body 36. The openings 78 have disposed in opposing end portions thereof respective integral ramp means 80, each of which comprises an inclined surface 82 sloping downwardly from the upper surface of rim 42 to approximately the lower surface thereof and outwardly from the adjacent side wall of body 36. As shown more clearly in FIG. 4A, each of the ramp means 80 includes a locking surface 84 disposed angularly with respect to the inclined surface 82 of ramp means 80 and substantially orthogonally with respect to the adjacent side wall surface of body 36. Preferably, the respective locking surfaces 84 of the ramp means 80 are disposed substantially coplanar with the lower or back surface of rim 62.

Referring again to FIGS. 1 and 3, it may be seen that opposing longitudinal portions of the flange 62 offset similarly from the transverse centerline of cover 38 have disposed therein respective pairs of spaced parallel slots 86 and 88, respectively. Between each pair of slots 86 and 88, there is disposed a respective integral tab means 90 comprising a hinge portion 92 extending laterally outward from the central axial portion of cover 38 comprising plateau 64 and integrally joined to an orthogonal leg portion 93 spaced from the adjacent side surface of plateau 68. Each of the leg portions 93 is integrally joined to a locking crossbar 94 which extends transversely of the leg portion 93 and has an adjacent side surface 95 disposed a predetermined distance from the flange 62 and inner surface 66 of plateau 64.

In securing the cover 38 over the opening of body 36 to form the unitary structure of dielectric insert 34, the cover 38 shown in FIG. 3 is inverted and oriented with respect to the body 36 shown in FIG. 2 so that each of the tab means 90 is aligned with a respective opening 78 in the rim 42. Consequently, as shown in FIG. 4A, when the cover 38 is pressed toward the rim 42 of body 36, each of the crossbars 94 enter the respective aligned openings 78 and have opposing end portions brought into engagement with respective ramp means 80 therein as shown in FIG. 4. Further urging of the cover 38 toward the body 36 causes the hinge portions 92 and the leg portions 93 of the respective tab means 90 to flex slightly and allow the crossbars 94 thereof to move laterally outward from the adjacent side wall of body 36 while travelling along the inclined surfaces 82 of respective ramp means 80. When the crossbars 94 are passed the inclined surfaces 82, as shown in FIG. 4B, the hinge portions 92 and the leg portions 93 of the tab means 90 flex back toward a more relaxed position and cause the crossbars 94 to move laterally toward the adjacent side walls of body 36. Consequently, the side surfaces 95 of the respective locking crossbars 94 are brought into locking engagement with the locking surfaces 84 of the respective ramp means 80.

While the end portions of crossbars 94 are moving along the inclined surfaces 82, the plateau 64 of cover 38 enters the cavity 44 of body 36 and moves toward the grommet portions 58 and 60 of the respective contact-retaining means 54 therein. Thus, it may be seen that the inner surface 66 of plateau 64 and the surfaces 95 of the crossbars 94 are disposed respective predetermined distances from the flange 62 so that when the flange 62 interfaces with rim 42 of body 36, the inner surface of plateau 64 is disposed approximately in abutting relationship with the respective contact-retaining means 54 and the surfaces 95 of crossbars 94 are disposed in locking engagement with the locking surfaces 84 of the respective ramp means 80. Also, it may be noted that having the openings 78 and the tab means 90 offset from the transverse centerlines of the body 36 and the cover 38, respectively, provides keying means for properly orienting the cover 38 with respect to the body 36 to position the arrays 72 and 74 of through-holes 70 in registration with respective arrays 50 and 52 of contact-receiving holes 48. Consequently, each of the through-holes 70 in the cover 38 secured over the opening of body 36 is disposed in registration with a respective contact-receiving hole 48 in the bottom wall of body 36.

Referring again to FIG. 1, it may be seen that the latching means 40 comprises the respective ramp means 80 provided on body 36 and the respective tab means 90 provided on cover 38 for securing the cover 38 over the opening of body 36, as described, to form the unitary box-like structure of dielectric insert 34. The cover 38 may be provided with a substantially flat outer surface 96 from which prong-like end portions of male terminal contact members 26 protrude when installed in the dielectric insert 34. However, as stated previously, the terminal contact members may be of the female terminal contact type. Consequently, as shown in FIG. 1A, the connector 14 may be provided with an alternative dielectric insert 34A comprising the body 36 and a cover 38A, which is secured over the opening of body 36 by the latching means 40. Cover 38A is not provided with the outer surface 96 of cover 38. Instead, the outer surface of cover 38A has a central axial portion comprising an outer plateau 98 extending integrally from an outer surface 61A of an encircling flange 62A. The outer plateau 98 is provided with a plurality of through-holes 70A which are disposed in mutually spaced relationship in respective rows or linear arrays 72A and 74A similar to the respective arrays 72 and 74 of through-holes 70 in cover 38. However, the through-holes 70A have respective end portions extending outwardly from the outer surface 61A of cover 38A for supporting therein respective terminal contact members of the female socket type.

Figure 5A:
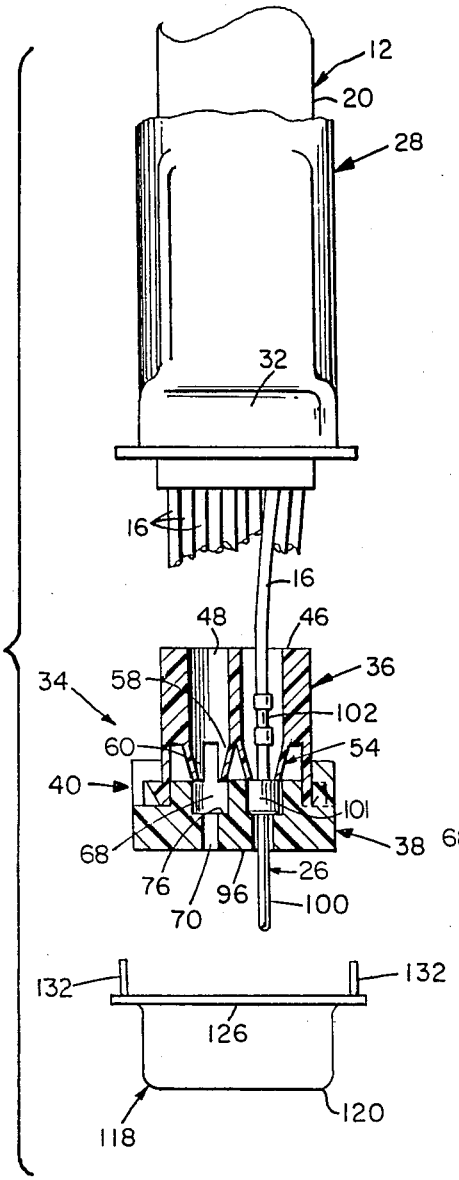
FIG. 5A is a schematic view, partly in section, showing a terminal male contact member installed in the dielectric insert shown in FIG. 1.

As shown in FIG. 5A, after the adjacent end portion of cable 12 is passed axially through the backshell 28, each of the conductors 16 may have secured to a stripped end portion thereof a respective terminal contact member 26 which may be of the conventional male type. Accordingly, the contact member 26 is provided with a prong-like leading portion 100, a ring-like intermediate portion 101 of relatively larger diametric size and a clamp-like trailing portion 102 which is crimped or staked by conventional means to a stripped end portion of a conductor 16. The prong-like leading portion 100 of each contact member 26 is inserted axially into a respective contact-receiving hole 48 in the bottom wall 46 from the exterior rear surface of dielectric insert 34. When the contact member 26 is urged axially inward of the hole 48, the ring-like intermediate portion 101 of contact member 26 forces the grommet portions 58 and 60 of split frusto-conical retaining means 54 to yield or flex laterally. Thus, the grommet portions 58 and 60 permit the ring-like intermediate portion 101 to pass through and then flex back to a relaxed position thereby capturing the contact member 26 and retaining it within the dielectric insert 34.

As a result the prong-like leading portion 100 of contact member 26 passes through the aligned feed-through hole 70 in cover 38 and protrudes from the substantially flat outer surface 96 thereof. The ring-like intermediate portion 101 is disposed in the cavity 74 where the terminating annular shoulder 76 functions as a positive-stop. Also, the annular shoulder 76 serves to retain the contact member 26 in dielectric insert 34 when subjected to axial pulling forces exerted when withdrawing the prong-like leading portion 100 from a female socket type of terminal contact member in a mating connector (not shown). The trailing end portion 102 of contact member 26 is protectively disposed in the portion of contact-receiving hole 48 between the contact-retaining means 54 and the exterior surface of bottom wall 46.

Figure 5B:
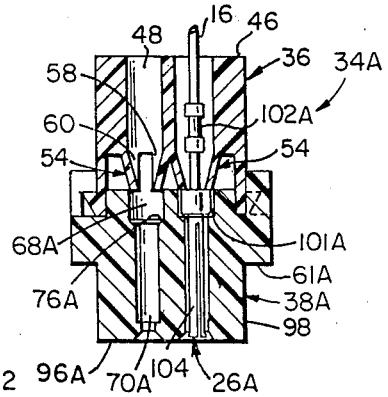
FIG. 5B is a cross-sectional view of the alternative dielectric insert shown in FIG. 1A with a terminal female contact dielectric installed.

As shown in FIG. 5B, each of the conductors 16, alternatively, may have their stripped end portions secured to a respective terminal contact member 26A which may be of the conventional female type. Accordingly, the contact member 26A is provided with a socket-like leading portion 104, a ring-like intermediate portion 101A of relatively larger diametric size, and a clamp-like trailing portion 102A which is crimped or staked by conventional means to the stripped end portion of conductor 16. The contact member 26A is inserted into a respective contact-receiving hole 48 in the manner described for installation therein of the male contact member 26. Thus, the grommet portions 58 and 60 yield or flex laterally for permitting the ring-like intermediate portion 101A to pass through and then the grommet portions 58 and 60 spring back to a relaxed position for retaining the contact member 26A within the dielectric insert 34A.

As a result, the socket-like leading portion 104 of contact member 26A is disposed in a feedthrough hole 70A which is similar to feedthrough hole 70 but extends through the outer plateau 98 to the exterior forward surface 96A thereof. The ring-like intermediate portion 101A of contact member 26A is disposed in cavity 74A which is similar to cavity 74 and serves a similar purpose. Also, the trailing end portion 102A of contact member 26A is disposed in the portion of contact-receiving hole 48 between the contact-retaining means 54 and the exterior surface of bottom wall 46.

Referring again to FIG. 1, the dielectric insert 34 is disposed for having the terminal contact members 26 installed, as described, and for supporting them in predetermined spaced relationship with one another independently of the backshell 28. Subsequently, the adjacent end portion of cable 12 may be drawn back through the backshell 28 thereby drawing the attached insert 34 into a rectangular opening 106 of slightly larger size in the larger end portion 32 of backshell 28. The walls of larger end portion 32 defining opposing ends of the rectangular opening 106 have extending orthogonally outward therefrom respective integral mounting flanges 108 and 110. Flanges 108 and 110 have respective front surfaces disposed substantially flush with the adjacent end of backshell 28 and are provided with respective through-apertures 112.

The walls of larger end portion 32 defining opposing longitudinal sides of the rectangular opening 106 have formed therein respective inwardly extending shoulders 114 and have extending therefrom respective recesses 116 which are offset similarly from the transverse centerline of opening 106. Shoulders 114 and recesses 116 are spaced from the adjacent end of backshell 28 a suitable distance for ensuring that the outer surface 96 of cover 38 is approximately flush with the adjacent end of backshell 28 when the opposing latching means 40 of insert 34 enter respective recesses 116 and the rim 42 of body 36 seats on the respective shoulders 114. Thus, it may be seen that the latching means 40 being offset from the transverse centerline of insert 34 and the recesses 116 being similarly offset from the transverse centerline of rectangular opening 106 provides keying means for ensuring that the insert 34 is properly oriented with respect to the backshell 28 for installing the insert 34 in the larger end portion 32 of backshell 28.

Figures 6A, 6B:
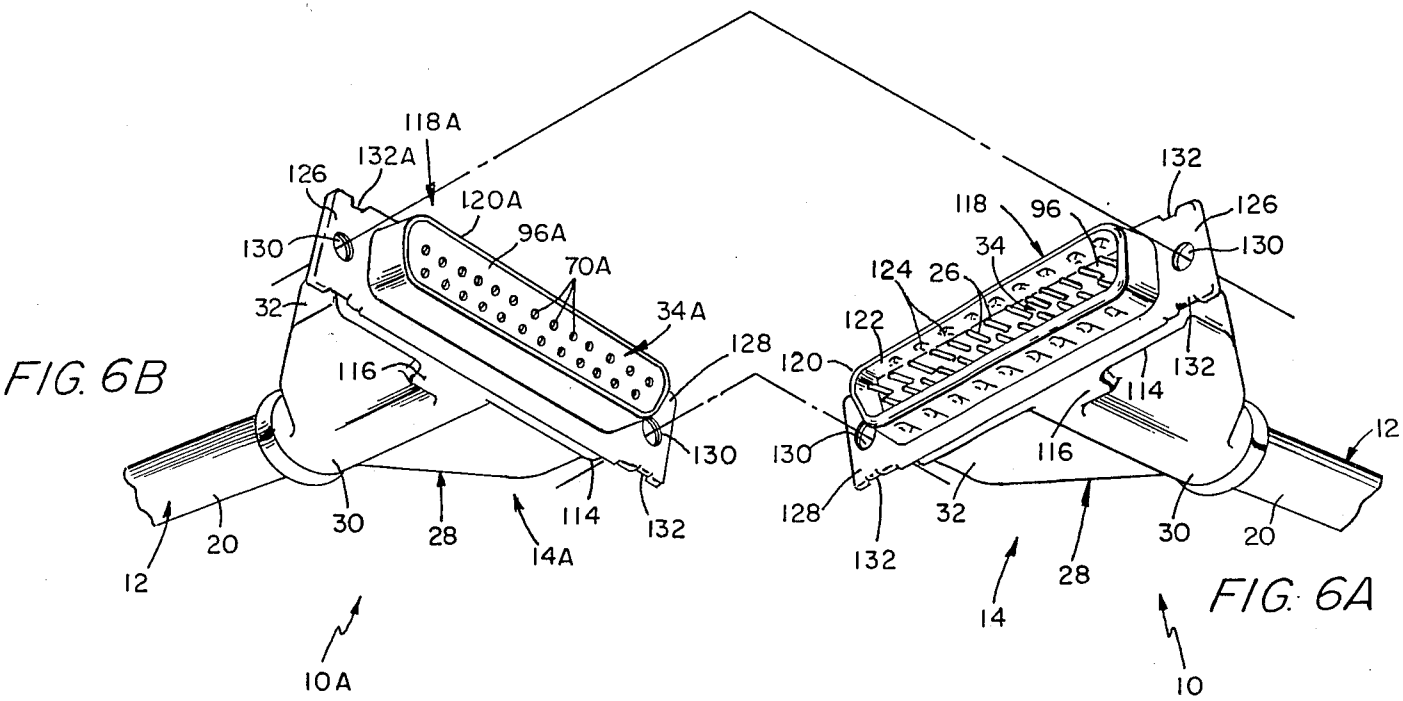
FIG. 6A is a isometric view of the electrical cable assembly shown in FIG. 1 but with the connector fully assembled.
FIG. 6B is a isometric view of a fully assembled, electrical cable assembly embodying the dielectric insert shown in FIG. 1A and the female contact members shown in FIG. 5B.

As shown in FIGS. 1 and 6A, the rigid shielding means includes a generally rectangular frontshell 118 made of electrically conductive material which preferably is seamless, such as drawn steel, for example. Frontshell 118 has protruding integrally from a central axial portion of its front surface a collar 120 which defines an elongated opening 122 extending through the thickness of frontshell 118. The opening 122 may be provided with opposing longitudinal sides, of unequal length and, consequently, opposing sloped ends. Also, the longitudinal sides of collar 120 defining the longitudinal sides of opening 122 may be provided with respective linear arrays of mutually spaced dimples 124 which protrude inwardly of the opening 122. Frontshell 118 also includes opposing end portions 126 and 128, respectively, which have centrally disposed therein respective through-apertures 130. Also, each of the end portions 126 and 128 has opposing side edges from which respective integral fastening tangs 132 extend orthogonally backward from the back surface of the frontshell 118.

The frontshell 118 is mounted over the insert 34 disposed within the rectangular opening 106 in larger end portion 32 of backshell 28 by aligning the opening 120 in frontshell 118 with the opening 106 and bringing the end portions 126 and 128 of frontshell 118 into interfacing relationship with the mounting flanges 108 and 110, respectively. Each of the flanges 108 and 110 may have disposed in opposing side edges thereof respective notches 134 into which the aligned tangs 132 extend. The tangs 132 may be bent, while held in the respective engaged notches 134, to bring the tangs 132 against the back surfaces of the mounting flanges 108 and 110 thereby holding the frontshell 118 tightly in place against the adjacent end of backshell 28. As a result, the through-apertures 112 in mounting flanges 108 and 110 are aligned with the respective through-apertures 130 in the end portions 126 and 128 of frontshell 118. One of the tangs 132 and the engaged notch 134 may be provided with respective width dimensions which are greater than the width dimensions of the other tangs and notches to provide keying means for ensuring that the longer longitudinal side of opening 122 defined by collar 120 is disposed adjacent the male contact pins 26 installed in the longer array 74 of through-holes 70 in the cover 38 of insert 34. Also, the collar 120 and the outer surface 96 of cover 38 form a bottomed cavity wherein a conformingly shaped end portion of a connector may be inserted for mating female terminal contact members to the prong-like end portions of male terminal contact members 26.

As shown in FIG. 6B, the mating connector may be embodied in an alternative cable assembly 10A comprising a connector 14A terminating an adjacent end portion of an electrical cable 12 which is similar to cable 12 shown in FIG. 1. The connector 14A comprises the dielectric insert 34A shown in FIG. 1B and a rigid shielding means including the backshell 28 having the smaller end portion 30 and the opposing larger end portion 32. Initially, the adjacent end portion of cable 12 is passed axially through the backshell 28 from the smaller end portion 30 to the larger end portion 32 thereof. Then, as shown in FIG. 5B, electrical conductors 16 in the cable 12 have stripped end portions secured to respective female terminal contact members 26A which are installed, as described, in the dielectric insert 34A. Thus, the dielectric insert 34A supports the installed contact members 26A in predetermined spaced relationship with one another independently of the backshell 28.

Subsequently, the adjacent end portion of cable 12 is drawn back through the backshell 28 thereby drawing the attached insert 34A into the rectangular opening 106 in the larger end 32 of backshell 28. The rigid shielding means of connector 14A includes a frontshell 118A which is similar to frontshell 118. However, when the frontshell 118A is mounted over the dielectric insert 34A and fastened to the adjacent end of backshell 28, as described, the outer plateau (FIG. 1A) 98 of insert 34A protrudes into the collar 120A of frontshell 118A until the outer surface 96A of the plateau 98 is nearly flush with the outer edge of collar 120A. Also, the collar 120A has respective dimensions which are slightly less than the corresponding dimensions of collar 120; and the longitudinal sides of collar 120A are not provided with respective linear arrays of mutually spaced dimples 124.

Accordingly, when the connector 14A is mated to the connector 14 for coupling the cable assembly 10A to the cable assembly 10, the collar 120A protrudes into the bottomed cavity formed by collar 120 and outer surface 96 of cover 38. Simultaneously, each of male terminal contact member 26 extend into the through-holes 70A in cover 38A (FIG. 5B) and electrically contact the female terminal contact members 26A therein. Also, the dimples 124 protruding inwardly from the longitudinal sides of collar 120 electrically contact the longitudinal sides of collar 120A. Thus, the rigid shielding means of connector 14, which encircles the dielectric insert 34, is electrically connected to the rigid shielding means of connector 14A, which encircles the dielectric insert 34A.

Figure 7A:
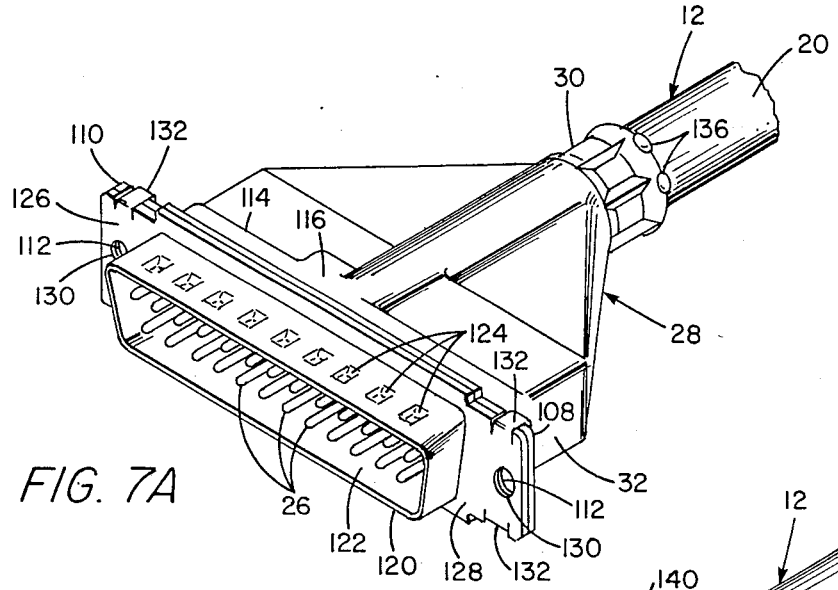
FIG. 7A is a isometric view of the electrical cable assembly shown in FIG. 6A but having the smaller end portion of the connector shell crimped about the cable.

As shown in FIG. 7A, the smaller end portion 30 of backshell 28, which preferably has an inner diametric size only slightly larger than the outer diametric size of cable 12, is crimped by conventional means onto the outer surface of jacket 20. Thus, the crimped end portion 30 provides a strain relief for protecting the electrical connections between conductors 16 and terminal contact members 26 within connector 14. Prior to crimping the smaller end portion 30, the shield pigtails 22 and 24 shown in FIG. 1 are laid back along the outer jacket 20 and have respective end portions extending out of the smaller end portion 30 of backshell 28. After crimping the smaller end portion 30, the protruding end portions of the respective pigtails 22 and 24 are trimmed and connected electrically, as by means of respective solder joints 136, for example, to the rim of smaller end portion 30.

Accordingly, the protective shielding provided by braided shield 18 in cable 12 (FIG. 1) is continued into the connector 14 by the rigid shielding means comprising backshell 28 and frontshell 118. In a similar manner, the protective shielding provided by the braided shield in cable 12A shown in FIG. 6B may be continued into the connector 14A by the rigid shielding means comprising backshell 28 and frontshell 118A. Thus, when the electrical cable assemblies 10 and 10A are coupled to one another, as described, the protective shielding is continuous through the junction formed by the respective connectors 14 and 14A.

Figure 7B:
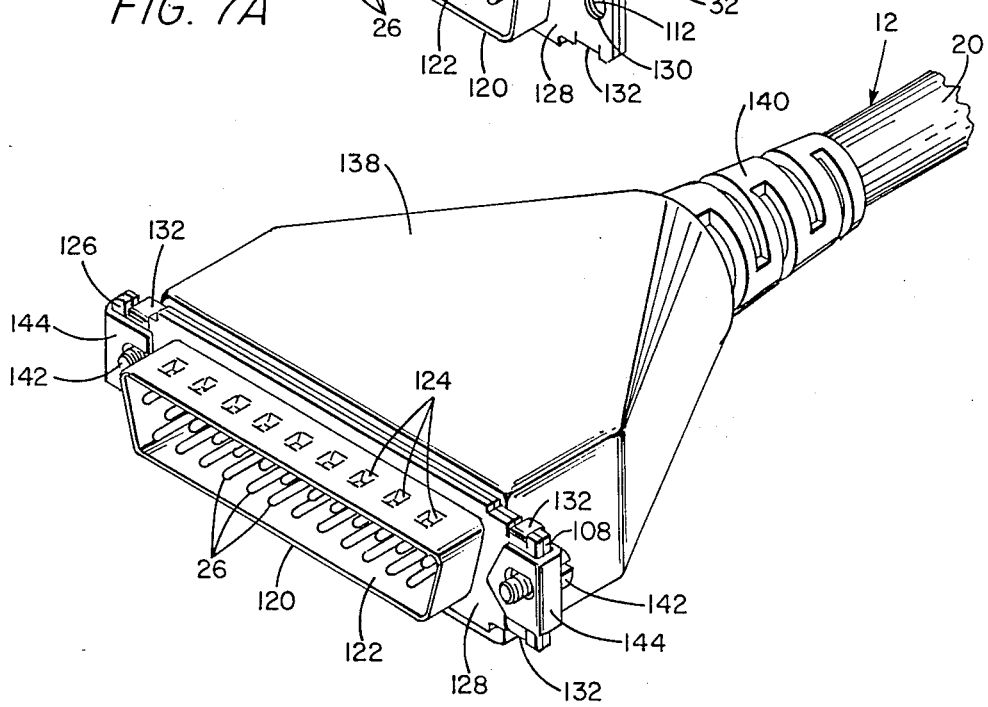
FIG. 7B is an isometric view of the electrical cable assembly shown in FIG. 7A but having the connector shell coated with dielectric molded material and a flexible strain relief bushing added.

As shown in FIG. 7B, the backshell 28 having the crimped end portion 30 shown in FIG. 7A may be subjected to a molding operation wherein the crimped end portion 30 serves as a "shut-off" means for preventing molding material from entering the backshell 28. Accordingly, the backshell 28 may be provided with an outer coating 138 of dielectric material, such as a moldable plastic material, for example, and may be provided with a flexible strain relief extension 140 made of the same material. The strain relief extension 140 has a large diameter end portion anchored around the crimped end portion 30 of backshell 28 and tapers rearwardly thereof along cable 12 to a terminating smaller diameter end portion. Thus, the strain relief extension 140 provides means for preventing sharp bends in the cable 12 adjacent the connector 14. Coating 138 does not extend onto the mounting flanges 108 and 110 (FIG. 1) which have their through-apertures 112 aligned with the respective through-apertures 130 in frontshell 118 for receiving conventional fastening means, such as respective screws 142 retained in the through-apertures by respective clips 144, for example. It should be readily apparent that the backshell 28A of connector 14A shown in FIG. 6B also may have its smaller end portion 30 crimped, such as shown in FIG. 7A, for example, and be provided with an outer dielectric coating and a flexible strain relief extension, such as shown in FIG. 7B, for example.

From the foregoing, it will be apparent that all of the objectives of this invention have been achieved by the structures and methods described herein. It also will be apparent, however, that various changes may be made by those skilled in the art without departing from the spirit of the invention as expressed in the appended claims. It is also to be understood, therefore, that all of the subject matter shown and described herein is to be interpreted as illustrative rather than restrictive of the invention.

What is claimed is:

1. An electric connector comprising:

a trough-like dielectric body having a transverse centerline and defining a contact-receiving cavity with an opening disposed in a longitudinal surface of said body and extended across said transverse centerline, said body including an integral array of contact retainer means in said cavity for supporting a corresponding array of electrical terminal contacts in said opening of said cavity;

an elongated dielectric cover means extended over said opening of said cavity and disposed on said surface of said body for forming with said dielectric body a contact-retaining insert having an exterior surface and having a transverse centerline coinciding with said transverse centerline of said body, said cover means including an array of aperture means corresponding to said array of contact retainer means and aligned therewith for receiving said array of electrical terminal contacts and maintaining said terminal contacts in predetermined spaced relationship with one another;

first and second dielectric latching and keying means disposed on respective opposing portions of said exterior surface and offset similarly from said transverse centerline of said insert for orienting said aperture means in said cover means with said contact retainer means in said cavity of said body and for removably securing said cover means to said body; and a rigid frame disposed about said exterior surface of said insert and having in opposing sides of said frame respective first and second keyway means aligned with said first and second latching and keying means, respectively, for receiving said first and second latching and keying means and for orienting said array of electrical terminal contacts with respect to said frame.

2. An electrical connector as set forth in claim 1 wherein each of said first and second latching and keying means includes a first latching element extended integrally from said body, and a second latching element extended integrally from said cover means into engagement with said first latching element.

3. An electrical connector as set forth in claim 2 wherein said first latching element comprises a ramp-like projection having an outwardly sloped surface adjacent said cover means and terminating in a locking surface of said ramp-like projection extended outwardly from said body at an acute angle with said sloped surface thereof.

4. An electrical connector as set forth in claim 3 wherein said second latching element comprises flexible tab means including a leg portion disposed for rubbing engagement with said sloped surface and for springing into latching engagement with said locking surface of said ramp-like projection.

5. An electrical connector as set forth in claim 4 wherein said flexible tab means includes flexible hinge means extended integrally from said cover means to said leg portion for flexing and allowing said leg portion to move laterally outward of said body when in rubbing engagement with said sloped surface and when being unlatched from said locking surface of said ramp-like projection in removing said cover means from said body.

6. An electrical connector comprising:

a trough-like dielectric body having a transverse centerline and defining a contact-receiving cavity in said body with an opening extended longitudinally across said transverse centerline, said body including a rim surface having therein said opening of said cavity and having first and second opposing longitudinal rim portions disposed adjacent respective first and second exterior longitudinal side surfaces of said body, said body also including an integral array of contact retainer means in said cavity for supporting a corresponding array of electrical terminal contacts in said opening of said cavity;

an elongated dielectric cover means extended over said opening of said cavity and disposed on said rim surface of said body, said cover means including an array of aperture means corresponding to said array of contact retainer means and aligned therewith for receiving said array of electrical terminal contacts and maintaining said terminal contacts in predetermined spaced relationship with one another, said cover means having first and second longitudinal edge portions disposed on said first and second longitudinal rim portions, respectively, for forming with said body a contact-retaining insert having a transverse centerline coinciding with said transverse centerline of said body and having first and second longitudinal sides comprised of said first and second exterior longitudinal side surfaces, respectively, of said body and said first and second longitudinal edge portions, respectively, of said cover means;

first and second dielectric latching and keying means disposed on said first and second longitudinal sides, respectively, of said insert and offset similarly from said transverse centerline thereof for orienting said array of aperture means in said cover means with respect to said array of contact retainer means in said cavity of said body and for removably securing said cover means to said body from said body means and said cover means for forming a latching joint externally of said structure when locking said cover means onto said body means and for ready accessibility in unlatching said joint when removing said cover means from; and rigid frame means defining an elongated opening for receiving therein said body of said insert, said frame means including first and second opposing longitudinal portions disposed adjacent said first and second longitudinal sides, respectively, of said insert and provided with respective first and second keyway means for receiving therein said first and second latching and keying means, respectively, and for orienting said array of terminal contacts with respect to said frame.

7. An electrical connector as set forth in claim 6 wherein said first and second latching and keying means includes respective first and second ramp-like projections having sloped surfaces extended integrally outward from portions of said first and second exterior longitudinal side surfaces, respectively, of said body adjacent said first and second rim portions, respectively, of said rim surface thereof and terminating in respective first and second locking surfaces extended integrally outward from said first and second longitudinal side surfaces, respectively, at an acute angle with said sloped surfaces of said ramp-like projections, said first and second locking surfaces being disposed at respective predetermined distances from said rim surface of said body.

8. An electrical connector as set forth in claim 7 wherein said first and second latching and keying means includes respective first and second flexible tab means having leg portions extended from segments of said first and second longitudinal edge portions, respectively, of said cover means and disposed for rubbing engagement with said sloped surfaces of said first and second ramp-like projections, respectively, and for springing into latching engagement with said first and second locking surfaces, respectively, thereof.

9. An electrical connector as set forth in claim 8 wherein said leg portions are provided with sufficient lengths for springing into said latching engagement with said first and second locking surfaces, respectively, when said cover means is disposed in interfacing relationship with said rim surface of said body.

10. An electrical connector as set forth in claim 9 wherein said leg portions terminate in angularly extended first and second bar portions, respectively, having surfaces disposed in said latching engagement with said locking surfaces of said first and second ramp-like projections, respectively.

11. An electrical connector as set forth in claim 9 wherein said trough-like body includes a bottom wall disposed in opposing relationship with said opening of said cavity and having an inner surface provided with said integral array of contact retainer means, said contact retainer means comprising a plurality of grommet means for receiving respective electrical terminal contacts of said array inserted into said cavity from externally of said body.

12. An electrical connector as set forth in claim 11 wherein said cover means includes plateau means extended integrally from an inner surface of said cover means for protruding into said cavity a predetermined distance measured from said rim surface of said body.

13. An electrical connector as set forth in claim 9 wherein said first and second opposing longitudinal rim portions of said rim surface comprise respective first and second flanges extended outwardly of said first and second longitudinal side surfaces, respectively, of said body, said first and second flanges having therein respective first and second gaps offset similarly from said transverse centerline of said body.

14. An electrical connector as set forth in claim 13 wherein said first and second flanges have respective thicknesses substantially equal to said predetermined distances of said locking surfaces from said rim surface of said body, and said ramp-like projections are disposed in said first and second gaps, respectively, of said first and second flanges.

15. An electrical connector as set forth in claim 14 wherein said first and second bar portions of said first and second flexible tab means, respectively, are disposed respective distances greater than said thicknesses of said first and second flanges, respectively, from said rim surfaces of said body.

16. An electrical connector as set forth in claim 14 wherein said opening in said rigid frame means for receiving therein said body of said insert includes first and second shoulder means extended inwardly of said first and second longitudinal portions, respectively, of said opening for interfacing with said first and second flanges, respectively.

17. An electrical connector as set forth in claim 16 wherein said first and second keyway means comprise respective first and second recess means communicating with said first and second shoulder means, respectively, for receiving therein, respective first and second bar portions of said flexible tab means.

* * * * *